United States Patent [19]

Garwood et al.

[11] 4,283,271

[45] Aug. 11, 1981

[54] MANUFACTURE OF HYDROCRACKED LOW POUR LUBRICATING OILS

[75] Inventors: William E. Garwood, Haddonfield; Murray R. Silk, Cherry Hill, both of N.J.

[73] Assignee: Mobil Oil Corporation, New York, N.Y.

[21] Appl. No.: 158,980

[22] Filed: Jun. 12, 1980

[51] Int. Cl.[3] ..... C10G 47/16; C10G 49/22

[52] U.S. Cl. ..... 208/59; 208/95; 208/100; 208/103

[58] Field of Search ..... 208/59, 18, 95, 100, 208/103

[56] References Cited

U.S. PATENT DOCUMENTS

| | | | |
|---|---|---|---|
| 3,852,207 | 12/1974 | Stangeland et al. | 208/58 |
| 4,137,148 | 1/1979 | Gillespie et al. | 208/87 |
| 4,162,962 | 7/1979 | Stangeland et al. | 208/58 |
| 4,181,598 | 1/1980 | Gillespie et al. | 208/58 |
| 4,183,801 | 1/1980 | Breuker et al. | 208/59 |
| 4,238,316 | 12/1980 | Mooi et al. | 208/58 |

*Primary Examiner*—Delbert E. Gantz
*Assistant Examiner*—G. E. Schmitkons
*Attorney, Agent, or Firm*—C. A. Huggett; M. G. Gilman; V. J. Frilette

[57] ABSTRACT

Hydrocracked, low pour lubricating oils of good stability are manufactured by passing a suitable hydrocarbon feed sequentially through a hydrocracking zone, a catalytic dewaxing zone, and a hydrotreating zone, all at high pressure and in that order, and with separation of hydrocrackate from recycle hydrogen prior to dewaxing. Only clean makeup hydrogen is fed to the dewaxer, passed through the hydrotreater, and then on to the hydrocracker, thereby providing an exceptionally efficient process.

8 Claims, 2 Drawing Figures

MANUFACTURE OF HYDROCRACKED LOW POUR LUBRICATING OILS

BACKGROUND OF THE INVENTION

1. Field of the Invention

This invention is concerned with a process for the manufacture of lubricating oils. In particular, it is concerned with a particular combination of unit processes whereby a hydrocracked lube oil of good stability and low pour point is produced with high energy efficiency.

2. Prior Art

Refining suitable petroleum crude oils to obtain a variety of lubricating oils which function effectively in diverse environments has become a highly developed and complex art. Although the broad principles involved in refining are qualitatively understood, the art is encumbered by quantitative uncertainties which require considerable resort to empiricism in practical refining. Underlying these quantitative uncertainties is the complexity of the molecular constitution of lubricating oils. Because lubricating oils for the most part are based on petroleum fractions boiling above about 450° F., the molecular weight of the hydrocarbon constituents is high and these constituents display almost all conceivable structures and structure types. This complexity and its consequences are referred to in "Petroleum Refinery Engineering," by W. L. Nelson, McGraw Hill Book Company, Inc., New York, N.Y., 1958 (Fourth Edition), relevant portions of this text being incorporated herein by reference for background.

In general, the basic notion in lubricant refining is that a suitable crude oil, as shown by experience or by assay, contains a quantity of lubricant stock having a predetermined set of properties such as, for example, appropriate viscosity, oxidation stability, and maintenance of fluidity at low temperatures. The process of refining to isolate that lubricant stock consists of a set of subtractive unit operations which removes the unwanted components. The most important of these unit operations include distillation, solvent refining, and dewaxing, which basically are physical separation processes in the sense that if all the separated fractions were recombined one would reconstitute the crude oil.

Unfortunately, crude oils suitable for the manufacture of lubes are becoming less available due to exhaustion of reserves, and the reliability of a steady, adequate supply from a known source is a matter of concern due to political instability.

The desirability of upgrading a crude fraction normally considered unsuitable for lubricant manufacture to one from which good yields of lubes can be obtained has long been recognized. The so-called "hydrocracking process," sometimes referred to in the art as "severe hydrotreating," has been proposed to accomplish such upgrading. In this process, a suitable fraction of a poor grade crude, such as a California crude, is catalytically reacted with hydrogen under pressure. The process is complex in that some of the oil is reduced in molecular weight and made unsuitable for lubes, but concurrently a substantial fraction of the polynuclear aromatics is hydrogenated and cracked to form naphthenes and paraffins. Process conditions and choice of catalyst are selected to provide an optimal conversion of the polynuclear aromatic content of the stock, since this component degrades the viscosity index and stability of the stock. Also, in the hydrocracking process, paraffins can be isomerized, imparting good V.I. characteristics to the final lube product. For purposes of this invention, the term "hydrocracking" will be employed for the foregoing process step and to distinguish this step from the "hydrotreating" step to be described below, the purpose of the latter being to stabilize the lube base stock produced by hydrocracking. For purposes of this invention, the hydrocracking and hydrotreating steps may be distinguished also by the amount of hydrogen consumed, the hydrocracking step typically consuming about 1000–2000 SCF/bbl (standard cubic feet per barrel of feed) while the hydrotreating step consumes only about 100–200 SCF/bbl.

The hydrocracking process for increasing the availability of lube oils has an attractive feature that is not immediately apparent. Generally, the composition and properties of hydrocracked stocks are not particularly affected by the source and nature of the crude, i.e. they tend to be much more alike than lube fractions prepared from different crudes by conventional means. Thus, the process promises to free the refiner from dependence on a particular crude, with all of the advantages that this freedom implies.

Hydrocracked lube stocks, however, tend to be unstable in the presence of air when exposed to sunlight. On such exposure, a sludge is formed, sometimes very rapidly and in fairly substantial amount. This tendency in a lubricating oil is unacceptable. Additionally, some hydrocracked lube oils tend to darken or to form a haze.

Several methods have been proposed to correct the above-described instability. U.S. Pat. No. 4,031,016 to Berger et al proposes to add certain antioxidants to the hydrocracked oil. A second proposed approach is to hydrotreat the hydrocrackate. Variants of this approach are described in U.S. Pat. No. 3,666,657 which utilizes a sulfided mixture of an iron group metal and a Group VI metal for the hydrotreating stage; U.S. Pat. No. 3,530,061 which utilizes a hydrotreating catalyst having one or more elements from Group IIB, VIB and VIII at hydrogen pressure up to about 100 psig; and U.S. Pat. No. 4,162,962 which teaches to hydrotreat the hydrocrackate at a temperature in the 200° to 300° C. range with a catalyst of prescribed pore size. U.S. Pat. No. 3,530,061 to Orkin et al utilizes a non-cracking support for the hydrotreating stage. U.S. Pat. No. 3,852,207 to Stangeland et al teaches to hydrotreat with a noble metal hydrogenation component supported on an oxide. The patents cited above are believed representative of the state of the art, and each is incorporated herein by reference.

Hydrocracked lubricating oils generally have an unacceptably high pour point and require dewaxing. Solvent dewaxing is a well-known and effective process but expensive. More recently catalytic methods for dewaxing have been proposed. U.S. Pat. No. Re. 28,398 to Chen et al describes a catalytic dewaxing process wherein a particular crystalline zeolite is used. To obtain lubricants and specialty oils with outstanding resistance to oxidation, it is often necessary to hydrotreat the oil after catalytic dewaxing, as illustrated by U.S. Pat. No. 4,137,148 to Gillespie et al. The foregoing patents are incorporated herein by reference as background, and indicate the state of the dewaxing art.

It is inferentially evident from the foregoing background material that the manufacture of modern high quality lubricants in general requires that the crude be treated in a sequence of fairly complex and costly steps. It is further evident that there is a need for processes which can efficiently provide such lubricants from interchangeable and readily available low grade crudes.

It is an object of the present invention to provide an improved process for the manufacture of hydrocracked lubricating oils. It is a further object to provide a method for manufacturing hydrocracked lubricating oils having a low pour point and good resistance to light. It is a further object of this invention to provide an energy-efficient process for manufacturing hydrocracked lubricating oils. These and other objects will become evident to one skilled in the art on reading this entire specification including the appended claims.

SUMMARY OF THE INVENTION

Figure 1:
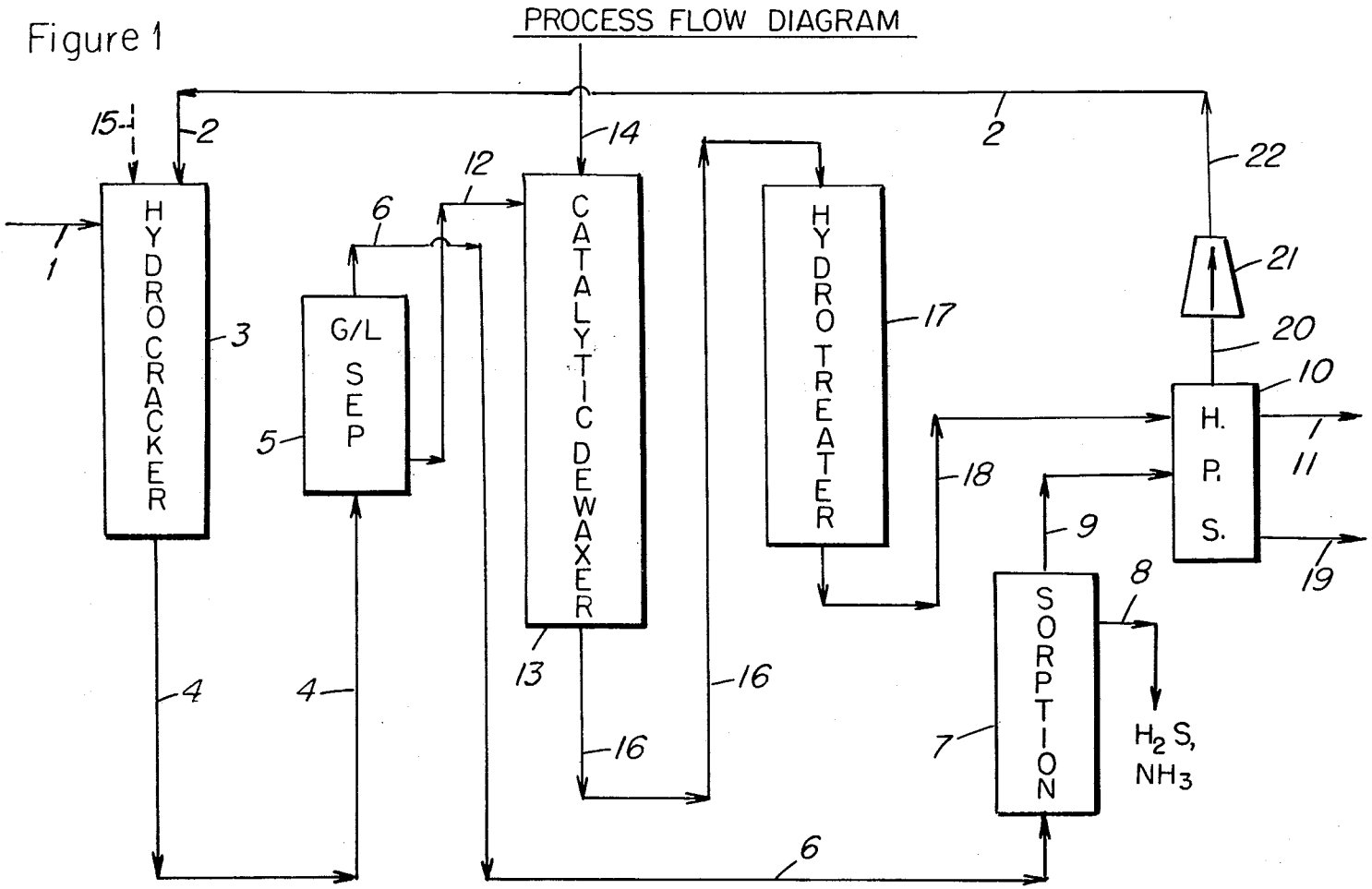
FIG. 1 Process flow diagram illustrates relation of process units and hydrogen flow.
Figure 2:
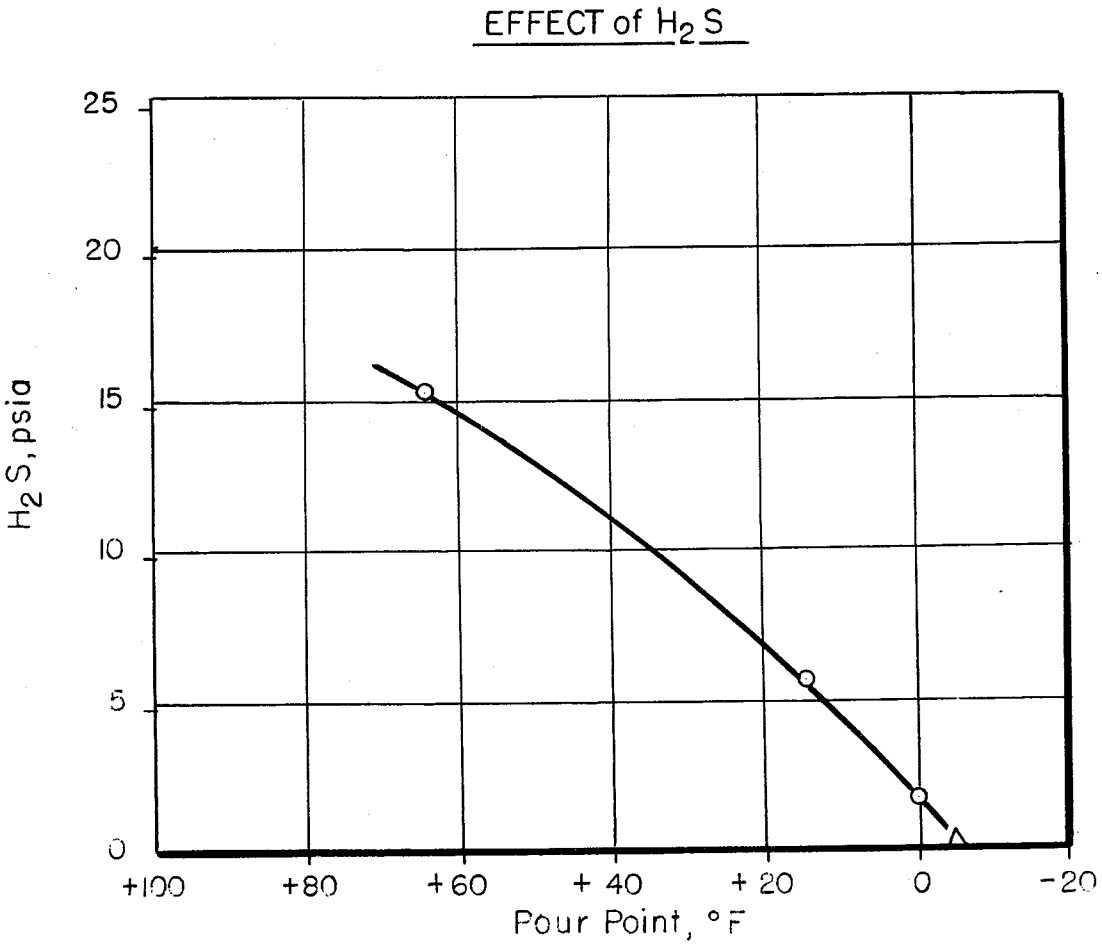
FIG. 2 Effect of $H_2S$ on pour-point reduction.

This invention provides an energy-efficient process for manufacturing a stabilized and dewaxed hydrocracked lubricating oil stock from a hydrocarbon feedstock boiling above about 650° F. (343° C.), such as vacuum gas oils, and resids substantially free of asphaltenes. The process comprises passing the feed sequentially through a hydrocracking zone, a catalytic dewaxing zone provided with a dewaxing catalyst exemplified by ZSM-5 and a hydrotreating zone at high pressure conditions in each of said zones such that hydrogen recycle is effected with minimal recompression.

The effluent hydrogen from the hydrocracking zone is separated from the hydrocrackate and is treated to remove at least a substantial portion, i.e. at least 50%, of the $H_2S$ and of the ammonia produced in the hydrocracking zone, as more fully described below, and the purified hydrogen is recycled to the hydrocracker. Simultaneously, fresh hydrogen substantially free of hydrogen sulfide and ammonia is introduced into the catalytic dewaxer and passed on a once-through basis together with the separated hydrocrackate through the catalytic dewaxer and then through the hydrotreater section, after which excess hydrogen is separated and combined with the recycle hydrogen for passage to the hydrocracker. The amount of fresh hydrogen introduced into the catalytic dewaxer section is about equal to, or less than, the amount consumed in the process of this invention, as more fully described hereinbelow.

The process provided by this invention with the catalytic dewaxing step following the hydrocracking step and preceding the stabilizing step requires only one stabilizing step to produce stable, dewaxed hydrocracked lubricant base stock. And, since only makeup hydrogen, which is already clean, is introduced to the catalytic dewaxing section as herein described, catalytic dewaxing efficiency is sustained without the necessity of a very high degree of purity of recycle hydrogen passed to the hydrocracker. In fact, if a sulfided catalyst is employed in the hydrocracking zone, its effectiveness is maintained better when some hydrogen sulfide is present in the recycle hydrogen, as is known to those skilled in the art.

In a preferred embodiment of this invention the hydrogen recirculation to the hydrocracker is maintained with a pressure difference not greater than about 750 psig between the inlet and outlet of a single compressor, which may be a multi-stage compressor.

EMBODIMENTS

The process of this invention will now be illustrated by reference to FIG. 1 of the drawing.

The feed, which may be any hydrocarbon feedstock boiling above about 650° F. (343° C.), such as a heavy neutral oil or a deasphalted residuum, is introduced via line 1 together with hydrogen via line 2 to hydrocracker section 3. Hydrocracker section 3 includes a catalytic hydrocracking zone at conditions effective to convert in a single pass at least 20%, of the feed to materials boiling below the initial boiling point of said feed.

The effluent from the hydrocracker 3 including excess hydrogen will be contaminated with free hydrogen sulfide and in some cases with ammonia, since the hydrocracking step, in addition to saturating aromatic compounds, also is accompanied by desulfurization and denitrogenation. This effluent is passed via line 4 to a high pressure gas-liquid separator (G/L Sep) 5 wherein the hydrocrackate is separated from contaminated hydrogen. The contaminated hydrogen is passed from separator 5 via line 6 to a high pressure sorption section 7 wherein a substantial fraction of the hydrogen sulfide and of the ammonia are removed via line 8.

The hydrogen from sorption unit 7 is passed via line 9 to a high pressure separator section 10 wherein it is separated from light hydrocarbons which are removed via line 11.

The hydrocrackate separated in separator section 5 is passed via line 12 to catalytic dewaxing section 13 along with makeup hydrogen introduced via line 14. It is important to note for purposes of this invention that the only hydrogen supplied to the catalytic dewaxer section 13 is fresh hydrogen having a hydrogen sulfide partial pressure of less than about 5 psia and less than 100 ppm of ammonia. The amount of hydrogen supplied via line 14 may be up to about the amount consumed in the process. Thus, all of the makeup hydrogen may be supplied via line 14. Alternatively, if it is desired to supply to the catalytic dewaxer 13 less than the makeup requirement of the system, the remainder may be supplied to the hydrocracker via line 15, or at any other point in the system.

Various zeolitic dewaxing catalyst, with or without hydrogenation component, may be used in dewaxing section 13. For example, the mordenite catalyst in the hydrogen form and containing a Group VI or Group VIII metal, as described in U.S. Pat. No. 4,100,056 to Reynolds, is suitable. Also useful and in fact preferred is ZSM-5 associated with a hydrogenation component as more fully described in U.S. Pat. No. Re. 28,398. Another preferred zeolite is ZSM-11 associated with a hydrogenation component such as nickel or palladium. ZSM-11 is more fully described in U.S. Pat. No. 3,709,979 issued Jan. 9, 1973. The foregoing patents are incorporated herein by reference. The preferred dewaxing catalyst comprises ZSM-5 or ZSM-11.

The effluent from the catalytic dewaxer, including excess hydrogen, is passed via line 16 to hydrotreater unit 17. Catalytic hydrotreater 17 contains a hydrotreating catalyst in a hydrotreating zone at stabilizing conditions. The effluent from the hydrotreater unit is passed via line 18 to a high pressure separation section 10 wherein it is treated to separate light hydrocarbons, which are removed together with a hydrogen bleed via line 11. Also separated is the hydrocarbon mixture comprising a stabilized and dewaxed hydrocracked lubricating oil stock, which is recovered via line 19. The hydrocarbon mixture containing the lubricating oil stock is passed via line 19 to another unit for recovery of the lubricating oil stock, which other unit is not part of this invention. The makeup and recycle hydrogen separated in section 10 is passed via line 20 to compressor 21 to raise its pressure and then passed via line 22 and line 2 to the hydrocracker 3.

In the preferred mode of operation, the pressure in line 20, which is downstream from pump 21, and the pressure in line 22, which is upstream of pump 21, do not differ by more than about 750 psig.

The embodiment shown in FIG. 1 of the process of this invention illustrates this invention, which provides for processing a hydrocarbon oil by the sequence of steps comprising hydrocracking, catalytic dewaxing and stabilization, in that order, with only fresh hydrogen provided to the catalytic dewaxer. It is known that hydrocracking by itself results in an unstable oil, and catalytic dewaxing in some instances also contributes to instability. By disposing the catalytic dewaxing step between the hydrocracking and stabilization step in the manner described in this invention, a very efficient process results with the production of a stabilized and dewaxed hydrocracked lubricating oil stock.

It will be recognized by those skilled in the art that various separation steps conducted at high pressure may be advantageously incorporated in the process flow diagram of FIG. 1. For example, a high pressure separation unit may be located in line 12 or line 16, for example, to remove a low molecular weight fraction of hydrocarbon not suitable for inclusion in the final lubricant base stock, thereby reducing the hydrocarbon load to subsequent sections.

The reaction conditions for the catalytic process steps herein described are summarized in Table I.

TABLE I

| | Hydro-cracking | Dewaxing | Hydro-treating |
|---|---|---|---|
| Pressure, broad, psig | 1000-3000 | same | same |
| Pressure, preferred | 1500-2500 | same | same |
| Temperature, broad, °F. | 500-900 | 450-900 | 350-700 |
| Temperature, broad, °C. | 260-482 | 232-482 | 176-371 |
| Temperature, preferred, °F. | 650-800 | 525-800 | 400-600 |
| Temperature, preferred, °C. | 343-427 | 274-426 | 204-316 |
| LHSV*, broad | 0.1-5.0 | 0.2-20 | 0.1-10 |
| LHSV, preferred | 0.5-2.0 | 0.5-5 | 0.2-3.0 |
| $H_2$ gas, SCF/bbl, broad | 1000-20,000 | 500-20,000 | 500-20,000 |
| $H_2$ gas, SCF/bbl, preferred | 2000-10,000 | 500-3000 | 500-3000 |

*LHSV = liquid hourly space velocity, i.e. volumes of feed per hour per volume of catalyst.

Although the catalytic process steps per se individually are not regarded as part of this invention, it is here noted that a wide variety of hydrocracking catalysts are contemplated as suitable for use in the process of this invention. Such catalysts in general possess an acid function and a hydrogenation function, exemplified by a porous acidic oxide such as a silica alumina or silica zirconia associated with a nickel-tungsten or palladium or platinum, or cobalt-moly or nickel-moly component. In general, a Group VIII metal or a combination of a Group VI and a Group VIII metal, as the oxides or sulfides thereof, deposited on silica alumina or silica zirconia, may serve as hydrocracking catalyst. The hydrocracking itself may be conducted in two or more stages, with pretreatment of the raw feed as part of the first stage. Catalyst suitable for the dewaxing and hydrotreating steps have been described above.

Attention is called to U.S. patent application Ser. No. 159,011, filed on even date herewith which is concerned with subject matter related to but different from that of the present application.

What is claimed is:

1. A continuous process for producing a dewaxed lubricating oil base stock characterized by good stability on exposure to light and air from a hydrocarbon feedstock boiling above about 650° F. (343° C.), which process comprises:

hydrocracking said feedstock in a hydrocracker section containing a hydrocracking zone at hydrocracking conditions including a pressure of 1000 to 3000 psig, said conditions being effective to convert at least 20 volume percent of said feedstock to materials boiling below the initial boiling point of said feedstock, said conversion being accompanied by the consumption of hydrogen and the formation of hydrogen sulfide and ammonia contaminants;

passing the hydrocracker effluent to a high pressure gas-liquid separator whereby hydrocrackate is separated from contaminated hydrogen gas;

passing said hydrocrackate and fresh makeup hydrogen to a catalytic dewaxing section wherein the hydrocrackate is catalytically dewaxed in a high pressure dewaxing zone;

passing the effluent from the catalytic dewaxing section, comprising dewaxed hydrocrackate and hydrogen gas to a high pressure hydrotreating zone operated at conditions effective to stabilize the lube base stock in said hydrocrackate;

passing the hydrotreater effluent to a high pressure separator section thereby recovering makeup hydrogen gas and hydrocarbons comprising said dewaxed, stable lubricating oil base stock;

passing said contaminated hydrogen gas to a high pressure sorption section wherein a substantial fraction of said hydrogen sulfide and ammonia are removed, thereby forming recycle hydrogen; and passing said recycle hydrogen and said makeup hydrogen to said hydrocracker section.

2. The process described in claim 1 wherein said dewaxing catalyst comprises ZSM-5 or ZSM-11.

3. The process described in claim 2 wherein said catalytic dewaxing is conducted at a pressure of about 1000 to 3000 psig, a temperature of about 525° F. (274° C.) to 800° F. (426° C.), and a L.H.S.V. of 0.2 to 20.

4. The process described in claim 1 wherein the pressure of said recycle hydrogen is increased by not more than about 750 psi prior to passage to said hydrocracker section.

5. The process described in claim 2 wherein the pressure of said recycle hydrogen is increased by not more than about 750 psi prior to passage to said hydrocracker section.

6. The process described in claim 3 wherein the pressure of said recycle hydrogen is increased by not more than about 750 psi prior to passage to said hydrocracker section.

7. The process described in claim 1 wherein said dewaxing catalyst comprises mordenite associated with a hydrogenation component.

8. The process described in claim 1 or 2 or 3 or 4 or 5 or 6 wherein the amount of said fresh makeup hydrogen passed to said catalytic dewaxing section is about equal to the amount of hydrogen consumed in said process.

* * * * *